United States Patent [19]

Vandame

[11] Patent Number: 4,564,259

[45] Date of Patent: Jan. 14, 1986

[54] ELECTRICAL CONTACT ELEMENT

[75] Inventor: Bertrand Vandame, Villepreux, France

[73] Assignee: Precision Mechanique Labinal, Bois D'Arcy, France

[21] Appl. No.: 701,180

[22] Filed: Feb. 13, 1985

[30] Foreign Application Priority Data

Feb. 14, 1984 [FR] France ..... 84 02204

[51] Int. Cl.[4] ..... H01R 13/11

[52] U.S. Cl. ..... 339/258 R

[58] Field of Search ..... 339/256 R, 256 SP, 258 R, 339/258 P, 258 S

[56] References Cited

U.S. PATENT DOCUMENTS

| | | | |
|---|---|---|---|
| 2,746,024 | 5/1956 | Ostrak | 339/256 SP |
| 4,076,369 | 2/1978 | Ostapovitch . | |

FOREIGN PATENT DOCUMENTS

| | | | |
|---|---|---|---|
| 2710165 | 9/1978 | Fed. Rep. of Germany . | |
| 2415890 | 9/1979 | France | 339/258 F |
| 626449 | 10/1961 | Italy | 339/256 SP |
| 1113856 | 5/1968 | United Kingdom | 339/258 S |
| 1584571 | 2/1981 | United Kingdom . | |

*Primary Examiner*—Joseph H. McGlynn

*Attorney, Agent, or Firm*—Sandler & Greenblum

[57] ABSTRACT

Electrical contact element designed to produce an electrical connection by interacting with a male element and including means for its connection to an electric circuit at one end while the other end is bent to form a channel with a base side, a top side opposite the base side, and an elastic strap which functions in gripping the male element, wherein the elastic strap has a first portion applied against the base side and prolonged by an inclined second portion which is bent in the shape of a hairpin and prolonged by a portion which extends towards the free end of the channel and towards the base side in such a way as to bear against a point on the top side.

22 Claims, 11 Drawing Figures

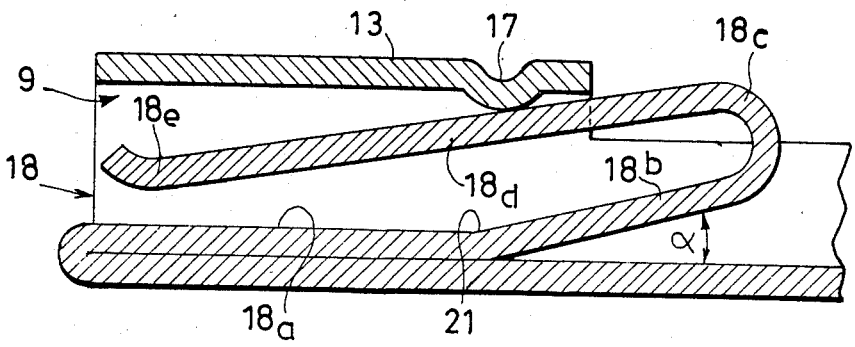
FIG.3
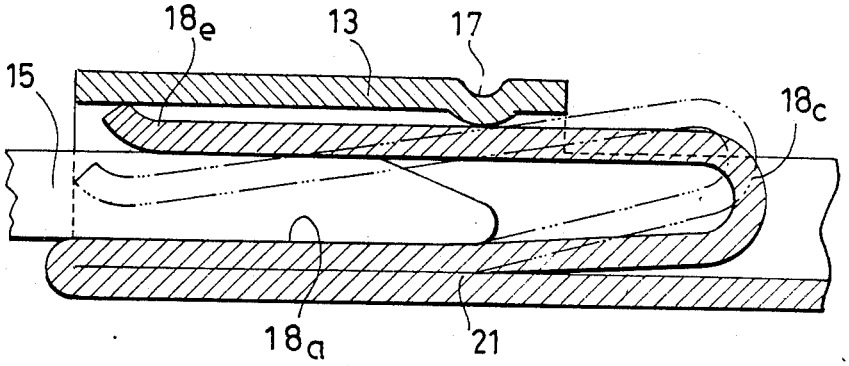
FIG.4
FIG.6
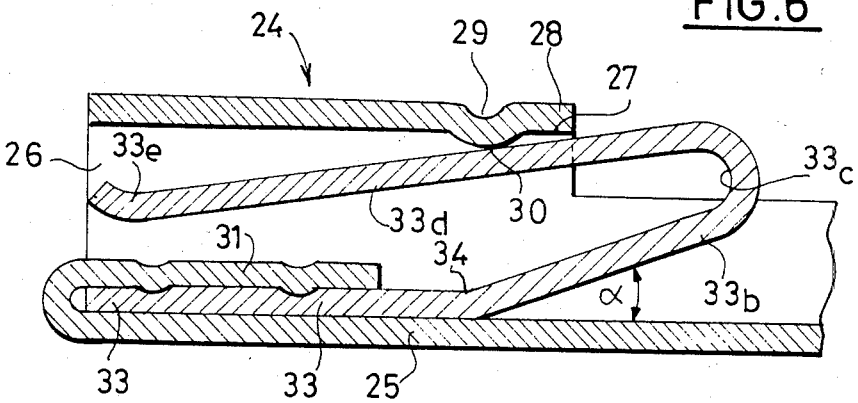

ELECTRICAL CONTACT ELEMENT

BACKGROUND OF THE INVENTION

1. Technical Field of the Invention

The present invention relates to an electrical contact element designed to be connected to an electrical conductor, circuit, or similar devices. More particularly, the electrical contact element of the present invention is designed to interact with a male electrical contact, which is also provided with means for connection to a conductor, a circuit, or similar devices, in order to establish a connection.

2. Discussion of the Prior Art

The prior art includes electrical contact elements including means for connection to an electrical circuit at one end while the other end takes the form of a channel containing an elastic strap, integral therewith or added thereto, which serves to grip a male element in order to provide the electrical connection. It has been found, however, that the elastic strap of prior art devices becomes deformed over time through use. When this happens, the connection is loose and the electrical contact is often faulty.

SUMMARY OF THE INVENTION

One of the purposes of the present invention is to remedy the foregoing drawbacks.

The electrical contact element according to the present invention is of the type designed to receive a male element. At one end it is provided with means for its connection to an electrical circuit, such as a conductor, a printed circuit etc. The other end takes the form of a channel with a base side and a lateral side; and an elastic strap which functions in gripping a male contact element in the channel. The elastic strap is novel in that it includes a first section positioned against the base side and a second section inclined at an acute angle with respect to the base side. This second section is U-shaped and is preferably bent to the shape of a hairpin. One leg of the second section may be prolonged by a portion having a free end extending towards the base side, on the side opposite to the connection means, in such a way as to bear against a point on the side opposite to the base side.

Thus, when a male element of an electrical contact is inserted into the electrical contact element of the present invention, it will be clamped between the free end and the first section of the elastic strap. The first section of the elastic strap preferably has a slight deformation the portion forming the prolongation of the part bent hairpinwise. This deformation is adapted to bear against a point on the side opposite to the base side. As a result, a particularly good connection is achieved when the male element is relatively thin.

On the other hand, when the male element is thicker, the gap required to permit the male element to be inserted is obtained by moving the second section of the elastic strap closer to the base.

Thus, an efficient electrical connection is achieved, even if male elements of different thicknesses are used. Furthermore, inasmuch as the bearing point against the side opposite to the base side intensifies the elastic action of the strap, deformation and damage to the strap is minimized.

The channel may be three-sided, but is preferably rectangular in cross section, with a base side, two lateral sides and a top side opposite to the base. The two lateral sides are provided with slits opening at the free end of the electrical contact element. In a preferred embodiment, electrical connections can be achieved by using two identical elements turned opposite to each other and upside down. As such, the electrical connection is obtained by engaging the free end of the base side and the first section of the elastic strap of one of the elements between the first section of the elastic strap and the portion forming the prolongation of the hairpin-shaped part of the other element, with the other being positioned in the first element in the same manner.

The lower surface of the side opposite to the base may also have a projection against which the elastic strap abuts. According to one embodiment of the present invention, the projection against which the elastic strap abuts is formed by a shaped portion.

In one embodiment of the present invention, the elastic strap is formed by a prolongation of the base side which is bent inside the channel. In another, the elastic strap consists of a separate piece of material added on to the element. In the latter instance, the elastic strap and the base side of the channel may be made of different materials.

In accordance with yet another embodiment, the base side of the device is designed with a curved clamp serving to form a housing into which the first section of the elastic strap is inserted.

In order to make it easier to insert a male element into the device of the present invention, the free end of the elastic strap terminates in a portion which curves in the direction of the side opposite to the base. Related to this, the curved free end of the elastic strap preferably comprises a shaped portion forming a projection facing towards the base. Moreover, the side opposite to the base has a notch situated on a level with the curved free end of the elastic strap. Thus, comparatively large male elements can be introduced into the channel of the contact element, and the curved free end can then come to rest in the notch.

The invention will now be described in greater detail by reference to certain constructional versions illustrated solely as examples in the accompanying drawings.

BRIEF DESCRIPTION OF THE DRAWINGS

FIG. 3 is a sectional view on a large scale, through an axial longitudinal plane of the contact element according to the invention.

FIG. 4 is a view on the same lines as FIG. 3 but showing how the electrical contact element functions.

FIG. 6 is a sectional view, on the same lines as FIG. 3, of another embodiment of the invention.

DETAILED DESCRIPTION AND PREFERRED EMBODIMENT

Figure 1:
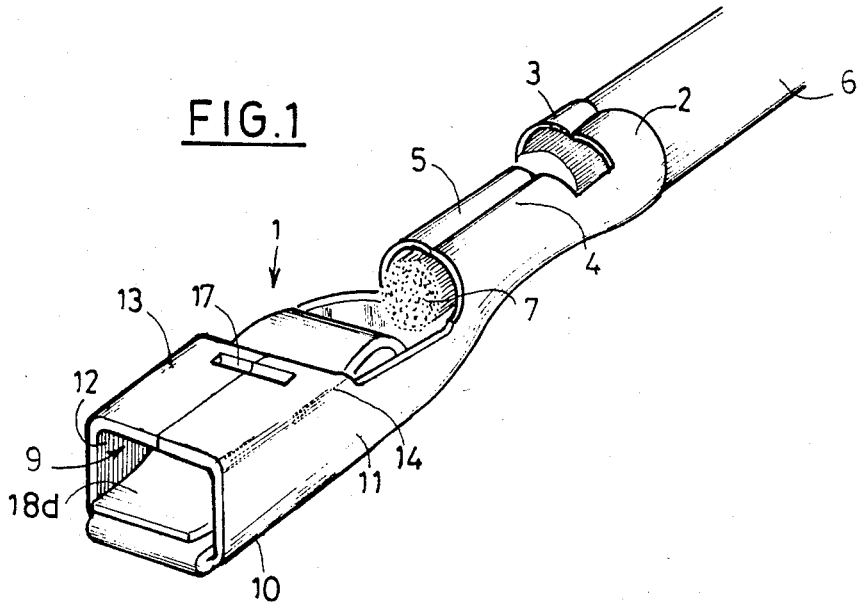
FIG. 1 is a perspective view of an electrical contact element according to the invention.
Figure 2:
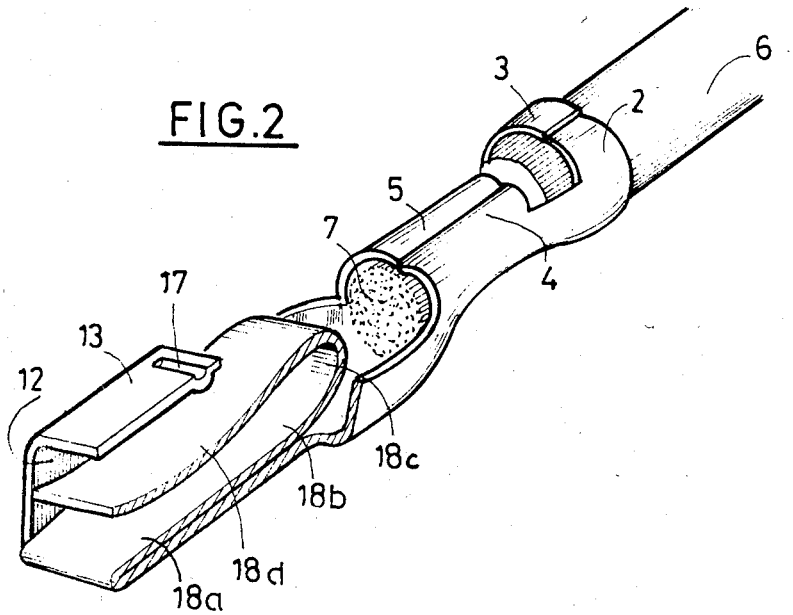
FIG. 2 is another perspective view but with certain parts removed.

The contact element shown in the drawings is made from an elastic metal strip of high electrical conductivity and suitably cut and bent to form a body 1 provided at one end with curved clamping portions 2 and 3 designed to enclose the sheath 6 of an electrical conductor. The body 1 also is provided curved clamping portions 4 and 5 designed to enclose the electrical conductor 7 suitably laid bare.

The body 1 is bent to form a channel 9 of rectangular cross section, having a base side 10, two lateral sides 11 and 12 and two portions 13 and 14 bent over in order to extend parallel to the base 10 to form a top side. As shown, the bent portions 13 and 14 include a shaped portion 17 forming a projection inside the channel 9.

The base side 10 includes a prolongation 18 bent to form an elastic strap. The first portion 18*a* of the elastic strap is bent in such a way as to bear against the base 10, a second portion 18*b* is bent along a line 21 and inclined away from the base 10, a third portion 18*c* is bent in the shape of a hairpin, and a fourth portion 18*d* is inclined towards the portion 18*a* and bears against the shaped part 17, while the free end 18*e* of the strap 18*d* terminates in a portion bent on the opposite side of the base.

The shaped part 17 and the bending line 21 are situated substantially in one and the same plane perpendicular to the base 10.

As may be seen from FIG. 3, an angle $\alpha$ of about 15° is formed between the base side 10 and the second portion of the elastic strap 18*b*. This angle decreases when a tongue 15 is introduced (as shown in FIG. 4). In operation, when a male element 15 is introduced between the portions 18*a* and 18*d* of the strap, no appreciable deformation occurs in portion 18*c*. To the contrary, the entire prolongation tends to tilt about a line corresponding to the bending line 21 separating portions 18*a* and 18*b*. The gap between the branches 18*b* and 18*d* of the strap are thus limited by the shaped portion 17. This ensures that electrical contact will be produced regardless of the thickness of the male elements.

Figure 5:
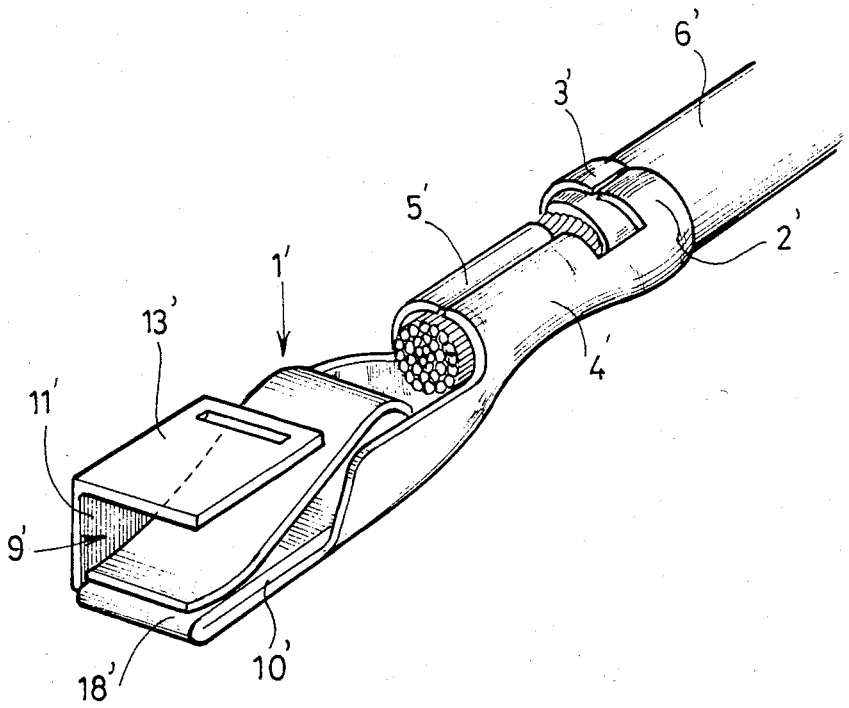
FIG. 5 is a perspective view, of a variant of the contact element shown in FIG. 1.

FIG. 5 shows another embodiment of the element illustrated in FIGS. 1–4. In this version the same reference numbers have been used for the components corresponding to those in the preceding drawings but with the addition of an apostrophe.

The contact element comprises a body 1 with curved clamping parts 2',3', 4' and 5' serving to connect it to an electrical conductor 6'.

The body 1' is bent to form a channel 9' having a base side 10', a lateral side 11' and a top side 13' substantially parallel to the base 10'.

The base side 10' has a prolongation 18' bent as in the preceding version and forming the elastic strap.

The contact element shown in FIG. 5 functions in the same manner as previously described with respect to FIGS. 1–4. The difference resides in the shape of the channel 9', which only has three sides.

FIG. 6 shows an alternative embodiment of the invention in which the element is provided at one end with means for connecting it to a conductor, such as the curved clamping parts 2, 3, 4 and 5 (not shown), and a body 24 with a channel 26 having a base 25, two lateral sides 27, and bentover parts 28 with a shaped portion 29 forming a projection 30 towards the inside.

The base 25 is provided with a clamping part 31 which curves into the channel and which combines with the base side 25 to form a housing into which is inserted a strap 33. Strap 33 has a first part 33*a* bearing against the base 25, a second part 33*b* bent along a line 34 and inclined away from the base 25, a third part 33*c* bent in the shape of a hairpin and a fourth part 33*d* bearing against the shaped portion 30. As shown, the elastic strap 33*f* terminates with a curved part 33*e*.

The first part 33*a* is preferably immobilized with respect to the base 25 by punching the curved clamping part 31. Alternatively, these parts can be rendered integral with each other, for example by welding.

The element shown in FIG. 6 functions in exactly the same manner as that shown in FIGS. 1–4 but enables the strap 33 to be made of a different material from the body 24. Such a feature may prove to be of considerable advantage for certain particular applications.

FIGS. 7–11 shows a third embodiment of the invention, the electrical contact element being in this case designed to interact with an identical element turned opposite to it and upside down.

The contact element shown in these drawings is made from an elastic metal band of good electrical conductivity which is cut and bent in such a way as to provide a body 41 having curved clamping parts 42 and 43 at one end designed to enclose the sheath 46 of an electrical conductor and with curved clamping parts 44 and 45 designed to grip that part of the electrical conductor 47 from which the sheath has been suitably removed.

The body 41 is bent to form a channel 49 of rectangular section. This includes a base side 50, two lateral sides 51 and 52 and two portions 53 and 54 bent over to extend parallel to the base 50. The bent-over parts may be provided with a notch 56 along their free edge. In addition, the bent-over parts may also include a shaped portion 57 forming a projection 59 inside the channel 49 in the vicinity of the opposite edge. The lateral sides 51 and 52 each have a slit 55 opening at the free end of the contact element.

The base side 50 comprises a prolongation 58 having a first portion 58*a* bent in such a way as to bear against the base 50, a second portion 58*b* bent along a line 61 and inclined away from the base 50, a third portion 58*c* bent in the shape of a hairpin, and a fourth part 58*d* inclined towards the portion 58*a* and bearing against the projection 59, the free end 58*e* of the strap 58*d* terminating in a point 70 curving towards the bent-over portions 53 and 54 and comprising a shaped portion 71 forming a projection on the surface of the free end 58*e* bent opposite the portion 58*e*.

The shaped portion 57, the projection 59 and the bending line 61 in this embodiment of the invention are situated in one and the same plane perpendicular to the base side 50.

Figure 9:
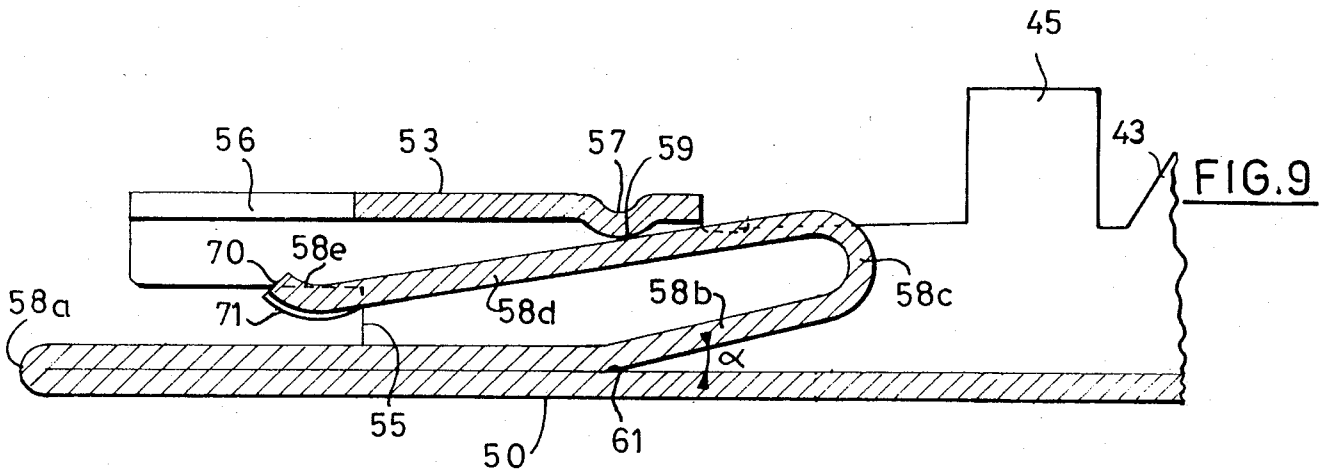
FIG. 9 is a sectional view, on a larger scale, through an axial longitudinal plane of the contact element of FIG. 7.

As may be seen from FIG. 9, an angle $\alpha$ of about 15° is formed between the base side 50 and the portion 58*b*. This angle decreases when an appropriate element (see FIG. 4-) or a tongue 75 (see FIG. 11) is introduced.

Figure 7:
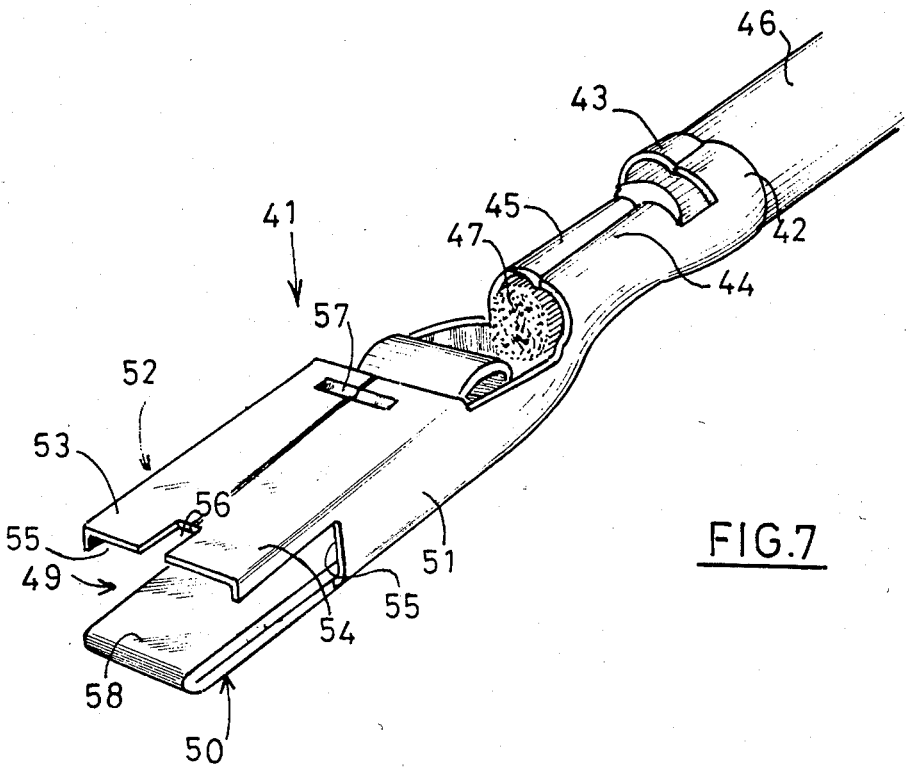
FIG. 7 is a perspective view of a contact element in yet another embodiment of the invention.
Figure 8:
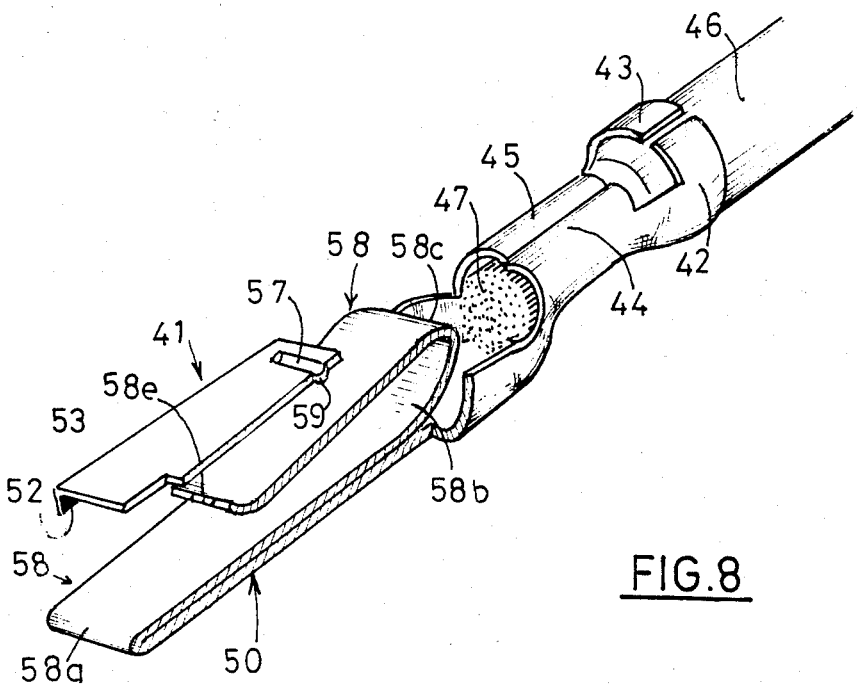
FIG. 8 is a perspective view, of the element shown in FIG. 7 but with certain parts removed.
Figure 10:
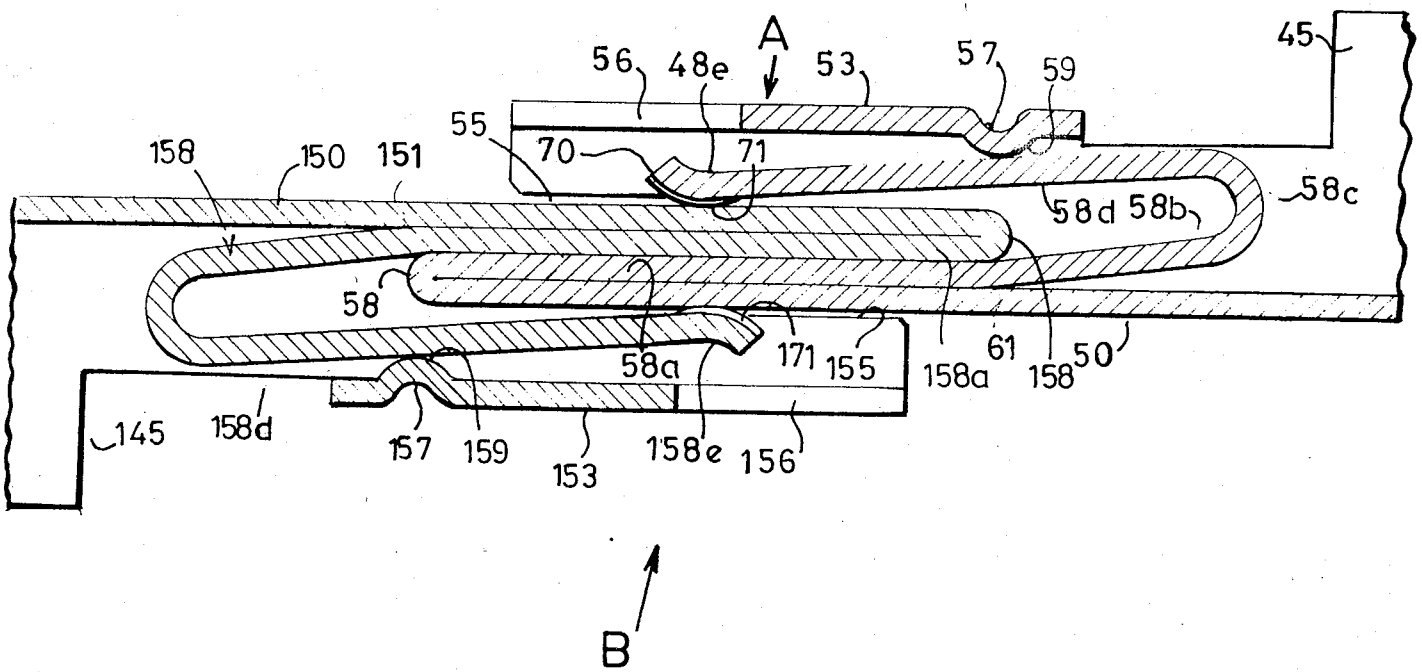
FIG. 10 is a sectional view of two assembled identical elements.

FIG. 10 is a sectional diagram of the connection made between two identical electrical contact elements such as that shown in FIGS. 7 and 9. To make the diagram easier to understand one of the elements, A, bears the reference numbers used in FIGS. 7–9 while the other, B, bears the same numbers increased by 100.

As may be clearly seen from FIG. 10, the male elements are formed by the base sides 50 and 150 and the portion 58*a* and 158*a* of the elements A and B.

The element B is turned in the opposite direction and upside down in relation to the element A, and two elements A and B are engaged in each other to the distance required to ensure that the base of the slits 55 abut against the base of the slits 155, the portion 158*a* coming to rest against the projection 58*a* while the base side 150 comes to rest against the projection 71 of the shaped portion of the end 58*c*. The base 50 of the element A bears against the projection 171 of the shaped portion of the elastic strap 158*d*. It may be clearly seen from this diagram that the angle $\alpha$ has decreased and that the elements of each contact element A-B are effectively clamped between the elastic straps 58*d* and 158*d* and the portion 58*a* and 158*a*.

Figure 11:
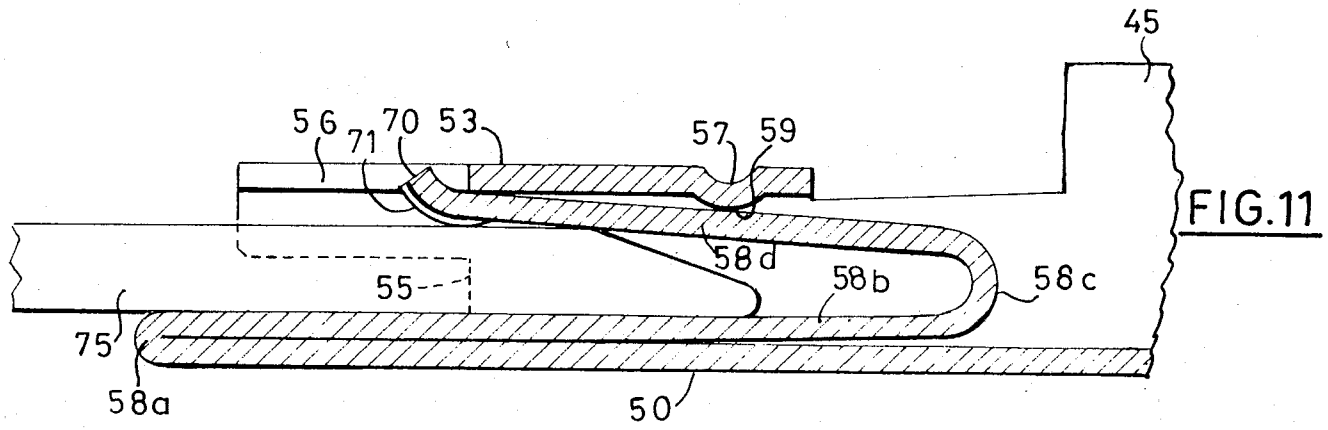
FIG. 11 is a sectional view of a contact element, such as shown in FIGS. 7–10, assembled with a flat tongue.

FIG. 11 shows the contact element of FIGS. 6–9 used with a male element marked 75. This male element 75 may consist of a simple flat strap of a metal of good electrical conductivity and provided at one end with means for its connection to an electric conductor. In the examples selected it has been assumed that the male element 75 is comparatively thick, and it may be seen that the portion 58*b* has tilted to just the right distance to enable it to come in contact with the base side 50, while the portion 58*c* is slightly opened. It will be noticed that the end 70 is inserted in the notch 56, giving greater freedom of movement to the portion 58*c*.

From the foregoing description, one skilled in the art can easily ascertain the essential features of the present invention, and without departing from the spirit and scope thereof, can make various changes and modifications of the invention to adapt it to various usages and conditions.

I claim:

1. An electrical contact element having a first end and a second end, said first end forming a means to communicate with an electrical circuit, and said second end forming a means for connection to another element, said means for connection including:

a channel comprising a base side and a lateral side; and an elastic strap comprising a first section positioned against said base side, and a second section inclined at an acute angle with respect to said base side, said second section being U-shaped with a free end.

2. An electrical contact element in accordance with claim 1, wherein said elastic strap is integral with said base side and extends within said channel.

3. An electrical contact element in accordance with claim 1, wherein said channel further comprises a top side.

4. An electrical contact element in accordance with claim 3, wherein said top side is formed by a portion of said lateral side bent to extend parallel over said base side.

5. An electrical contact element in accordance with claim 4, wherein said channel has three sides.

6. An electrical contact element in accordnce with claim 3, wherein said channel further comprises another lateral side.

7. An electrical contact element in accordance with claim 6, wherein said channel has a rectangular cross section.

8. An electrical contact element in accordance with claim 6, wherein said lateral side has a free end provided with a slit opening.

9. An electrical contact element in accordance with claim 3, wherein said second section of the elastic strap is bent in the shape of a hairpin and prolonged by a portion extending towards said base side.

10. An electrical contact element in accordance with claim 9, wherein said second section bears against a point on said top side opposite to said base side.

11. An electrical contact element in accordance with claim 10, wherein said top side has a lower surface opposite said base side, said lower surface having a projection against which said second section bears.

12. An electrical contact element in accordance with claim 11, wherein said projection is formed by a shaped portion.

13. An electrical contact element in accordance with claim 1, wherein said first section of said elastic strap is attached to said base side.

14. An electrical contact element in accordance with claim 13, wherein said elastic strap and said base side are made of different materials.

15. An electrical contact element in accordance with claim 13, wherein said base side is adapted to form a housing in which said first section of said elastic strap is inserted.

16. An electrical contact element in accordance with claim 15, wherein said base side is provided with a clamping portion to form said housing.

17. An electrical contact element in accordance with claim 16, wherein said first section of said elastic strap is secured to said clamping portion.

18. An electrical contact element in accordance with claim 2, wherein said free end of said elastic strap is curved.

19. An electrical contact element in accordance with claim 18, wherein said free end is curved in the direction of said top side away from said base side.

20. An electrical contact element in accordance with claim 19, wherein said curved free end has a shaped portion.

21. An electrical contact element in accordance with claim 20, wherein said shaped portion forms a projection on the side of said elastic strap facing said base side.

22. An electrical contact element in accordance with claim 21, wherein said top side is provided with an open area opposite said base side on a level with said curved free end.

* * * * *